US005463455A

United States Patent [19]

Pozniakas et al.

[11] Patent Number: 5,463,455

[45] Date of Patent: Oct. 31, 1995

[54] METHOD AND APPARATUS FOR ADAPTIVE CLEANER BLADE LUBRICATION

[75] Inventors: Robert S. Pozniakas, Rochester; Gary A. Minagawa, Fairport, both of N.Y.

[73] Assignee: Xerox Corporation, Stamford, Conn.

[21] Appl. No.: 161,611

[22] Filed: Dec. 6, 1993

[51] Int. Cl.[6] ..... G03G 21/00

[52] U.S. Cl. ..... 355/299; 355/296

[58] Field of Search ..... 355/296, 297, 355/299

[56] References Cited

U.S. PATENT DOCUMENTS

| | | | |
|---|---|---|---|
| 3,552,850 | 1/1971 | Royka et al. | 355/15 |
| 4,158,498 | 6/1979 | Ohmori | 355/299 |
| 4,937,633 | 6/1990 | Ewing | 355/299 |
| 4,945,388 | 7/1990 | Tange et al. | 355/296 |
| 5,027,161 | 6/1991 | Kume et al. | 355/297 X |
| 5,153,658 | 10/1992 | Lundy et al. | 355/301 |
| 5,166,730 | 11/1992 | Urabe | 355/208 |
| 5,204,698 | 4/1993 | LeSueur et al. | 346/160 |
| 5,204,699 | 4/1993 | Birnbaum et al. | 346/160 |
| 5,264,904 | 11/1993 | Audi et al. | 355/299 |

*Primary Examiner*—Fred L. Braun
*Attorney, Agent, or Firm*—Kevin R. Kepner

[57] ABSTRACT

An adaptive cleaner blade lubricating system for electrophotographic printing machines. In an electrophotographic printing machine, the amount of residual toner available to lubricate a cleaner blade is calculated based on the density of the transferred image. A band of toner is deposited in an inner document gap in selective widths so as to provide an adequate amount of toner to lubricate the cleaner blade across the full width of the photoreceptor. The lubricating band may be variable or may be a constant width with the frequency of placement of the band determined based on average image density for a group of documents. In the preferred embodiment, the width of the toner band is varied as a function of the overall residual toner in each pixel location across the width of the photoreceptor based on the density of the images transferred. As a result of the varying lubrication bands, the cleaner blade is maintained so as to not tuck and cause streaking and/or damage while toner efficiency is maximized.

8 Claims, 2 Drawing Sheets

METHOD AND APPARATUS FOR ADAPTIVE CLEANER BLADE LUBRICATION

Figure 1:
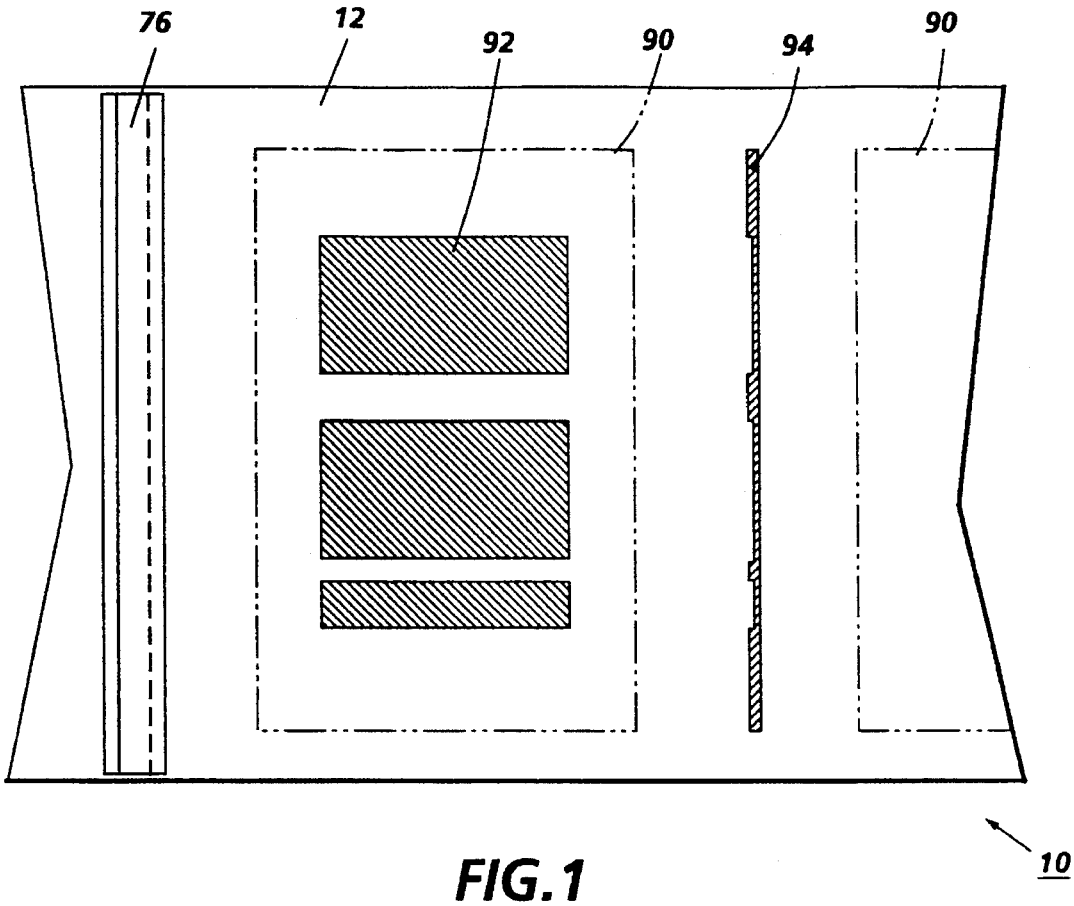

This invention relates generally to a cleaner blade lubrication system, and more particularly concerns an adaptive system to maintain cleaner blade lubrication while minimizing toner waste in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

One type of cleaning device utilized is a urethane blade which is configured in either a wiper or doctor mode to remove residual toner and other particles. In some instances a disturber brush is used in combination with the blade to remove paper debris and to disturb the residual toner image. It is known that the residual toner acts as a lubricant for the cleaner blade and helps to minimize blade tuck which can lead to streaking of the image at the very least or can cause blade and/or photoreceptor damage. One way of assuring proper blade lubrication is to place a toner swath across a photoreceptor at some known interval to assure blade lubrication.

It is desirable to be able to lubricate the blade with a minimum of extra toner and to fully utilize any residual toner to lubricate the cleaner blade. It is also desirable to provide a substantially uniform lubrication to the cleaning blade across its width.

The following disclosures may be relevant to various aspects of the present invention:

- U.S. Pat. No. 5,204,699 Patentee: Birnbaum et al. Issued: Apr. 20, 1993
- U.S. Pat. No. 5,204,698 Patentee: LeSueur et al. Issued: Apr. 20, 1993
- U.S. Pat. No. 5,153,658 Patentee: Lundy et al. Issued: Oct. 6, 1992
- U.S. Pat. No. 4,945,388 Patentee: Tange et al. Issued: Jul. 31, 1990
- U.S. Pat. No. 3,552,850 Patentee: Royka et al. Issued: Jan. 5, 1971
- U.S. application Ser. No. 08/062,971, now U.S. Pat. No. 5,349,377 Applicant: Gilliland et al. Filed: May 17, 1993

The relevant portions of the foregoing disclosures may be briefly summarized as follows:

U.S. Pat. No. 5,204,699 describes an apparatus and method used to measure the mass of toner use in a printing machine based upon a summing of individual toner mass signals generated as a function of image intensity signals.

U.S. Pat. No. 5,204,698 discloses a device which dispenses toner to a developer mixture depending upon the toner usage as calculated by the number of pixels to be toned so as to maintain the proper toner ratio in the developer mixture.

U.S. Pat. No. 5,153,658 describes a process for controlling the amount of film buildup on a photoreceptor surface in a single pass highlight color printer. The process defines a functional equation that maintains a toner concentration on a cleaner brush at the fiber tips to control filming on the photoreceptor.

U.S. Pat. No. 4,945,388 describes a method and apparatus to remove residual color toner from a photoreceptor by developing only black toner and cleaning the black toner and the residual color toner from the photoreceptor using a cleaning blade.

U.S. Pat. No. 3,552,850 describes an apparatus utilizing a cleaning blade and a toner with a lubricant additive to lubricate the cleaning blade.

U.S. application Ser. No. 08/062,971, now U.S. Pat. No. 5,349,377 discloses a toner usage device utilizing a weighted pixel counting scheme to more accurately estimate toner usage in an electrophotographic printing machine.

In accordance with one aspect of the present invention, there is provided an apparatus for adaptive cleaner blade lubrication. The apparatus comprises a photoreceptive member and an image density sensor, the image density sensor determining the density of an image to be transferred to a recording sheet and generating a signal indicative thereof. A controller, responsive to the signal from the image density sensor, the controller being adapted to determine the amount of toner required to properly lubricate the cleaner blade and means for depositing a quantity of toner on the photoreceptive member in a direction transverse to a process direction so as to provide cleaner blade lubrication are also provided.

Pursuant to another aspect of the present invention, there is provided a method of adaptive cleaner blade lubrication The method comprises the steps of calculating the density of an image to be transferred to a recording sheet and depositing a selective width toner band in a direction transverse to a process direction of movement of a photoreceptive member.

Figure 2:
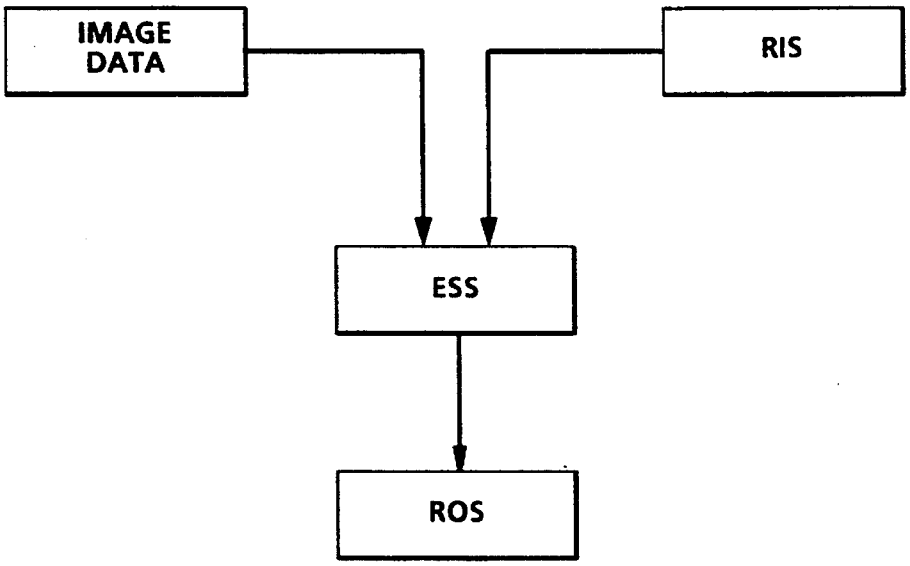
Figure 3:
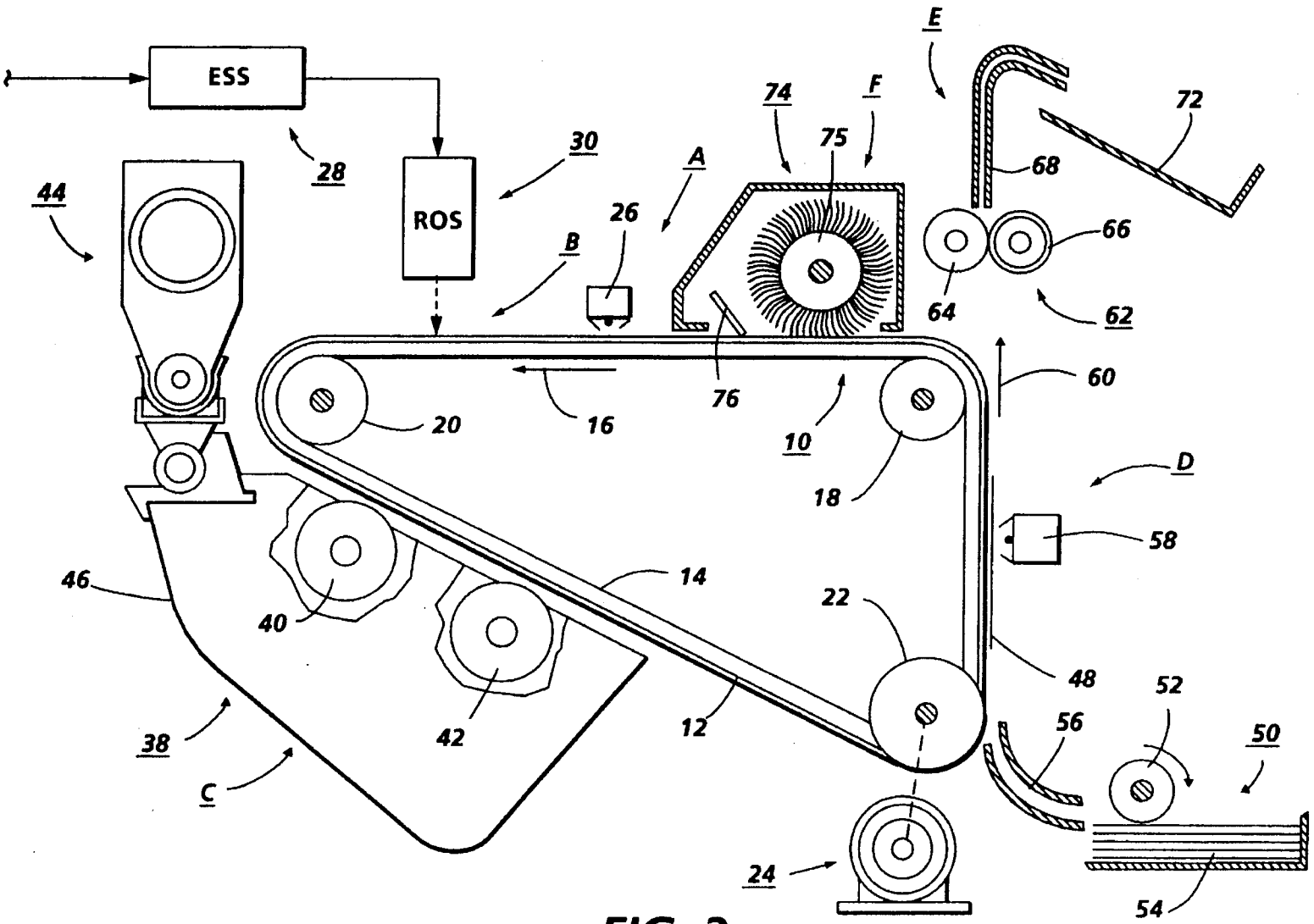

Other features of the present invention will become apparent as the following description proceeds and upon reference to the drawings, in which:

FIG. 1 is a plan view illustrating the scheme of the present invention as applied to a photoreceptor belt; and FIG. 2 is a block diagram illustrating the information flow in the FIG. 1 lubrication scheme; and FIG. 3 is a schematic elevational view of an electrophotographic printing machine including the cleaning blade lubrication system of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 3 schematically depicts an electrophotographic printing machine incorporating the features of the present invention therein. It will become evident from the following discussion that the sheet feeding apparatus of the present invention may be employed in a wide variety of devices and is not specifically limited in its application to the particular embodiment depicted herein.

FIG. 3 schematically illustrates an electrophotographic printing machine which generally employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 28, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 28 is a self-contained, dedicated minicomputer. The image signals transmitted to ESS 28 may originate from a computer, thereby enabling the electrophotographic printing machine to serve as a remotely located printer for one or more computers. Alternatively, the printer may serve as a dedicated printer for a high-speed computer. The signals from ESS 28, corresponding to the continuous tone image desired to be reproduced by the printing machine, are transmitted to ROS 30. ROS 30 includes a laser with rotating polygon mirror blocks. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 28. As an alternative, ROS 30 may employ a linear array of light emitting diodes (LEDs) arranged to illuminate the charged portion of photoconductive belt 10 on a raster-by-raster basis.

In another embodiment, ESS 28 may be connected to a raster input scanner (RIS). The RIS has an original document positioned thereat. The RIS has document illumination lamps, optics, a scanning drive, and photosensing elements, such as an array of charge coupled devices (CCD). The RIS captures the entire image from the original document and converts it to a series of raster scanlines which are transmitted as electrical signals to ESS 28. ESS 28 processes the signals received from the RIS and converts them to greyscale image intensity signals which are then transmitted to ROS 30. ROS 30 exposes the charged portion of the photoconductive belt to record an electrostatic latent image thereon corresponding to the greyscale image signals received from ESS 28.

After the electrostatic latent image has been recorded on photoconductive surface 12, belt 10 advances the latent image to a development station, C, where toner, in the form of liquid or dry particles, is electrostatically attracted to the latent image using commonly known techniques. As shown, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 3, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush 74 in contact with photoconductive surface 12 to disturb and remove paper fibers and cleaning blade 76 to remove the nontransferred toner particles. The blade 76 may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein. Moreover, while the present invention is described in the embodiment of a single color printing system, there is no intent to limit it to such an embodiment. On the contrary, the present invention is intended for use in multi-color printing systems as well.

Turning now to FIG. 1, the adaptive lubrication scheme of the present invention will be described. The cleaning blade 76 is shown in its relationship to the photoreceptor belt 12. A standard sheet size is indicated by the outlines 90. Shaded portions 92 represent the image data for a sheet. As the transfer efficiency of a modern electrophotographic printer is not 100%, a shadow 92 of the transferred image is left as a residual image on the photoreceptor after transfer. For the sake of clarity, the disturber brush is not shown in FIG. 1. The residual toner 92 acts as a lubricant for the cleaning blade 76 which helps to prevent the tip of the blade from tucking under which can cause streaking and/or damage to the blade 76 and photoreceptor 12. However, it can be seen in FIG. 1 that in the area where there is not a residual image there is almost no toner (there being only background toner) to provide blade lubrication.

The present invention applies a toner band 94 across the width of the photoreceptor in the area between the document image information (interdocument gap) to provide cleaning blade lubrication. The toner band 94 width is varied according to the image density so that toner is conserved There are several schemes by which the necessary information may be obtained to create the selective width toner band 94. Preferably, the ESS 28 generates a video pattern which discharges the photoreceptor belt in the charged interdocument gap. The resulting latent image passes through the development station C to create toner band 94. The toner band 94 moves to cleaner station F without being transferred by transfer station D.

Generally, in a typical digital printer there are a discrete number of possible spots or pixels which may be either black or white across the width (fast scan direction) of the photoreceptor. There may be 300 or more of these pixels per inch depending on the resolution of the printer. To calculate the amount of residual toner that will be available for blade lubrication, the number of black pixels in each location across the width (fast scan direction) of the photoreceptor is counted for a certain distance in the process (slow scan) direction. Based on this pixel count for each pixel width the amount of available toner for lubrication is then known based on the transfer efficiency of the particular machine. In areas across the width with little or no image data, the lubrication band is then made thicker so as to assure proper blade lubrication. In actual implementation it may only be necessary to count pixels over several areas across the belt to reduce the number of counters required. There will also be some transverse spreading of the toner across the blade as the toner areas are cleaned by the blade FIG. 2 is a block diagram illustrating information flow for the residual toner determination and lubrication band requirement for an image. The image information is fed from either a RIS input or as video data from an external source to the printing machine ESS. The ESS then causes the ROS to image the photoreceptor in the proper manner to form a latent image of the lubrication band which is then developed on the photoreceptor. The lubrication band may be absolutely variable across the photoreceptor or there may be a threshold band width level to which band width is increased based upon the image data. There may also be portions in which no lubricating band is required due to high residual toner levels.

The above scheme describes an isomorphic raster output, however, it is equally suitable to a high addressability anamorphic arrangement. The image data information may also be derived directly from a computer generated image or from a RIS.

A less precise scheme of laying a uniform toner band at certain intervals of documents based on average image coverage area per document may also be implemented. This scheme requires only that average coverage area per document be calculated by one of many known methods and then a fixed width toner band is placed in the interdocument zone when the calculated residual toner is not adequate for blade lubrication. This scheme does not selectively provide for specific white areas of a document as described above, however is particularly useful in the event that pitches (image area plus interdocument zone=1 pitch) are skipped on the photoreceptor for compilation or duplexing purposes.

In recapitulation, there is provided an adaptive cleaner blade lubricating system for electrophotographic printing machines. In an electrophotographic printing machine, the amount of residual toner available to lubricate a cleaner blade is calculated based on the density of the transferred image. A band of toner is deposited in an inner document gap in selective widths so as to provide an adequate amount of toner to lubricate the cleaner blade across the full width of the photoreceptor. The lubricating band may be variable or may be a constant width with the frequency of placement of the band determined based on average image density for a group of documents. In the preferred embodiment, the width of the toner band is varied as a function of the overall residual toner in each pixel location across the width of the photoreceptor based on the density of the images transferred. As a result of the varying lubrication bands, the cleaner blade is maintained so as to not tuck and cause streaking and/or damage while toner efficiency is maximized.

It is, therefore, apparent that there has been provided in accordance with the present invention, an intelligent cleaning blade lubrication system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for adaptive cleaner blade lubrication in a disturber brush/primary blade cleaner comprising:

a photoreceptive member having a number of pixels to be developed thereon to form an image;

a controller, which determines image density as a function of the number of pixels to be developed on said photoreceptive member in a process direction and calculates an amount of toner required to properly lubricate the cleaner blade; and means for depositing the quantity of toner on said photoreceptive member in a direction transverse to a process direction so as to maintain the disturber brush in a toned condition so as to provide cleaner blade lubrication.

2. An apparatus according to claim 1, wherein said depositing means varies a width of a toner band so as to provide more toner for lubrication purposes in one section of said photoreceptive member than in other sections.

3. An apparatus according to claim 1, wherein said depositing means varies the frequency of depositing the toner on said photoreceptive member in response to said controller blade lubricating determination.

4. An apparatus according to claim 1, further comprising a raster input scanner which determines the image on a pixel by pixel basis and emits a signal indicative thereof to said controller.

5. An apparatus according to claim 4, wherein said controller determines the area coverage over a distance in the process direction along the photoreceptive member for a discrete pixel location in a direction normal to the process direction of the said photoreceptive member so as to determine the available toner for cleaner blade lubrication.

6. An apparatus according to claim 1, wherein said means for depositing comprises a developer, adjacent said photoreceptive member to develope the pixel image with toner particles.

7. A method of adaptive cleaner blade lubrication in a disturber brush/primary blade cleaner comprising the steps of:

calculating the density of an image to be transferred to a recording sheet as a function of the number of pixels to be developed on a moving photoreceptive member; and depositing a toner band of a selected width, the selected width determined as a function of the calculated density of the image, in a direction transverse to a process direction of movement of the photoreceptive member.

8. A method of adaptive cleaner blade lubrication in a disturber brush/primary blade cleaner comprising the steps of:

calculating the density of an image to be transferred to a recording sheet as a function of the number of pixels to be developed on a moving photoreceptive member, wherein said calculating step comprises determining the value of each pixel in a scan direction normal to the process direction of movement of the photoreceptive member, averaging the number of pixels that are developed for each discrete pixel location over a selected distance in the process direction and generating a signal to control the depositing of the selective width toner band as a function of the determined image density values; and depositing a toner band of a selected width in a direction transverse to a process direction of movement of the photoreceptive member.

* * * * *